United States Patent [19]

Knapp

[11] 4,195,572

[45] Apr. 1, 1980

[54] PRESSURIZED PROJECTILE FOR DELIVERING AND DISPENSING LIQUIDS OR PARTICULATES

[75] Inventor: John S. Knapp, Pittsburgh, Pa.

[73] Assignee: Federal Laboratories, Inc., Saltsburg, Pa.

[21] Appl. No.: 902,180

[22] Filed: May 2, 1978

[51] Int. Cl.[2] ..... F42B 13/46

[52] U.S. Cl. ..... 102/90

[58] Field of Search ..... 102/6, 34.4, 37.6, 65, 102/65.2, 66, 90, 92; 244/3.29

[56] References Cited

U.S. PATENT DOCUMENTS

| | | | |
|---|---|---|---|
| 2,011,249 | 8/1935 | Larson | 102/92 |
| 2,271,280 | 1/1942 | Weinert | 244/3.29 |
| 2,854,925 | 10/1958 | Crockford et al. | 102/92 |
| 3,785,569 | 1/1974 | Helmrich | 102/65 |
| 3,831,520 | 8/1974 | Bowen et al. | 102/66 |

*Primary Examiner*—Charles T. Jordan

*Attorney, Agent, or Firm*—Albert F. Kronman

[57] ABSTRACT

A projectile suitable for launching by a gun or similar weapon, having a hollow housing within which there is carried a pressurized container having the material to be delivered therein. A piercing pin within the housing is spaced from the bottom of the container. When the projectile is launched by the firing of the weapon, the inertia of the container causes the piercing pin to penetrate the bottom of the container. The pin and container remain together until the projectile's forward motion is sharply reduced as by striking an object or the ground. The piercing pin is thereby dislodged, releasing the delivered material under pressure into the atmosphere.

Stabilizing fins and weights are provided to control the flight of the projectile.

4 Claims, 7 Drawing Figures

PRESSURIZED PROJECTILE FOR DELIVERING AND DISPENSING LIQUIDS OR PARTICULATES

BACKGROUND OF THE INVENTION

It is well-known to deliver and disperse material such as dusts, tear gas, insecticides, liquid droplets, aerosols or combinations thereof by means of projectiles employing pyrotechnic materials. In some of these devices, when the pyrotechnic material burns, the tear gas or other chemical is vaporized and issues as smoke. Other prior art devices contain an explosive charge which is used to expel and dispense the particulate or liquid material. The explosive charge is often detonated by the impact of the projectile against a solid object.

Where pyrotechnic material is used to disperse the contents of the projectile there is often the danger of fires being caused as the projectile lands. In addition, personal injury can result to those in the vicinity of the fired projectile.

Exploding projectiles can also injure persons near the projectile. Where the projectile does not land with sufficient impact to detonate, it can subsequently explode injuring an innocent party who discovers it at a later time.

Certain projectiles of the pyrotechnic type, mix the combustible material with the particulates or liquids to be dispensed resulting in a portion of the contents being consumed before reaching their target.

Accordingly, it is an object of the present invention to provide a projectile for delivering and dispensing liquids or particulates which will not require the use of explosive or pyrotechnic materials.

Another object of the present invention is to provide a projectile which will operate consistently even through it impacts on soft terrain.

A further object of the present invention is to provide a projectile which is simple in structure yet safe for loading and handling.

Still another object of the present invention is to provide a projectile which lends itself to a wide variety of materials and liquids for delivery and dispersal.

SUMMARY

Projectiles made in accordance with the present invention are constructed with a hollow housing within which there is slidably carried a container. The material to be delivered and dispersed is confined under pressure within the container. Longitudinal movement of the container within the housing prior to firing may be prevented by a pull pin thrust through openings in the housing.

When the pull pin is removed the projectile is launched by means of a gun or suitable weapon, in the well-known manner. The housing is provided with a piercing pin which is secured to the housing and disposed in the path of the container as it slides within the housing.

Upon launching, the inertia of the container causes the housing to move forward with respect to the container. The piercing pin then punctures the container body and remains in engagement with the container throughout the projectiles's flight. As the projectile impacts the piercing pin becomes dislodged and the contents of the container is dispersed from the pierced container body and through openings in the housing wall.

BRIEF DESCRIPTION OF THE FIGURES

In the accompanying drawings, forming part, hereof, similar parts have been given the same reference numerals, in which drawings.

DETAILED DESCRIPTION OF THE INVENTION

Figure 1:
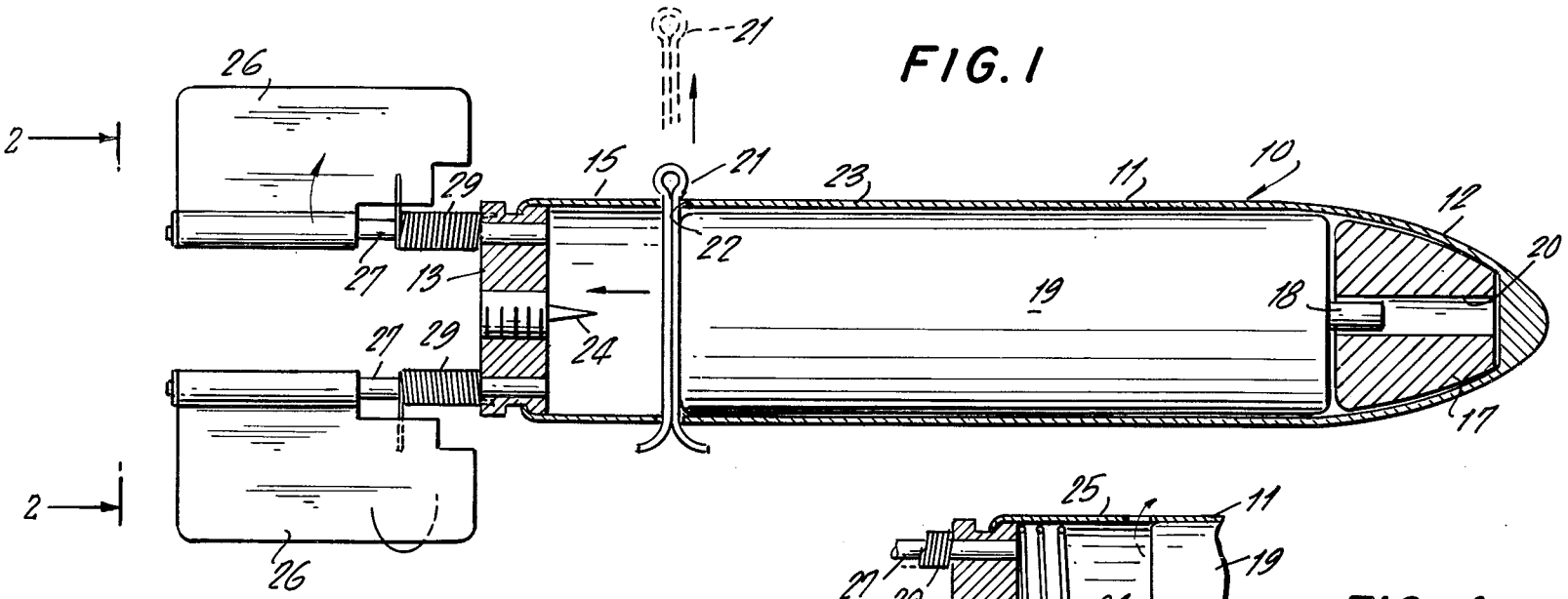
FIG. 1 is a view in longitudinal section of one complete embodiment of the present invention in the safety mode.

Referring to the drawings and particularly to FIGS. 1–5, there is shown a projectile 10 having an elongated hollow housing 11. The housing 11 is closed at its forward end in an ogival configuration as shown at 12. The rear of the housing is open to receive a base plug 13. The plug is provided with an annular groove 14 to receive a spun in portion 16 of the housing wall 11. A stabilizing weight 17 may be provided in the forward end of the projectile to improve its flight characteristics and inertia. The usual dispensing valve 18 of an aerosol or other pressurized container 19 is received within a bore 20 in the stabilizing weight 17 to prevent the usual discharge of the container contents.

The pressurized container 29 is slidably carried within the housing but is held in a forward or unarmed position until ready for use by a pull pin 21. Openings 22 in the wall 23 of the housing receive the pull pin 21 and also serve as exit ports for the contents of the container after the projectile impacts.

While the components making up the projectile have been shown as metal, it will be understood that other suitable material such as a wide variety of plastics and even rigidified paper may be substituted as will be apparent to those skilled in the art.

The base plug 13 is axially bored and threaded to receive a piercing pin 24 which extends in the direction of the bottom of the container 19. The pull pin 21 or a weak spring 15 (see FIG. 4) prevents the container from contacting the piercing pin 24 prior to launching.

Figure 2:
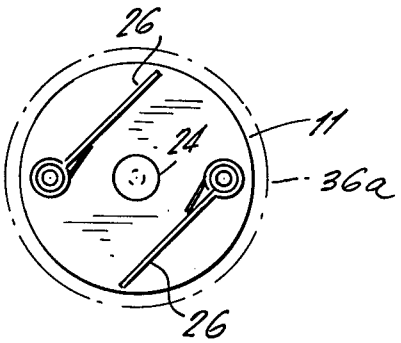
FIG. 2 is an end view taken on line 2–2 in FIG. 1 looking in the direction of the arrows with the fins folded.

In order to stabilize the projectile during flight, fins 26 may be carried by the end plug 13. The fins 26 are freely journaled upon stub shafts 27 which extend out of the base 28 of the said plug. Coil springs 29 secured at one end to the end plug 13 and at their opposite ends to the fins permit the fins to be swung inwardly as shown in FIG. 2 for loading into a gun barrel and to snap outwardly into the position shown in FIG. 3 during flight.

When it is desired to launch the projectile of FIGS. 1–5, the pull pin 21 is removed from the housing exit ports 22. The fins 26 are next swung inwardly and the projectile slipped into the barrel of a gun having a suitable propellant charge. When the gun is fired, the housing is forced violently forward as the projectile 10 is launched. The inertia of the container however, causes it to lag behind the movement of the housing 11 resulting in the condition shown in FIG. 5 in which the piercing pin 24 has punctured the bottom of the container 19. The coefficient of friction between the piercing pin and the bottom of the container 19 is such that the pin and container will remain in contact throughout the projectile flight although a small amount of the material in the container may escape, as indicated by the arrows 30 in FIG. 5.

As the projectile lands, the inertia of the container will drive it forward, releasing it from the piercing pin 24. This separation will take place not only if the projectile impacts on its front sealed portion 12 but also on a skipping landing. Impacting on a soft or hard material will also separate the container from the piercing pin 24.

With the container 19 separated, the material within the container is forced out of the container and through the exit ports 22 into the ambient air.

Figure 4:
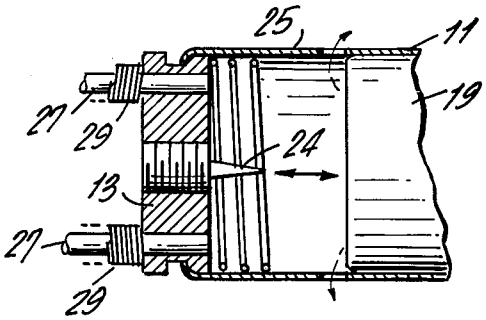
FIG. 4 is a fragmentary cross-sectional view of another piercing pin assembly.
Figure 3:
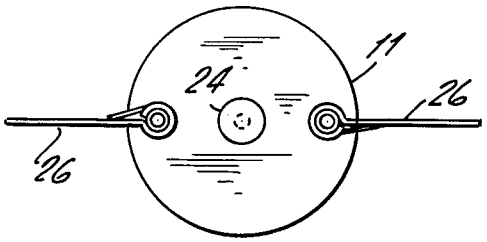
FIG. 3 is a view similar to FIG. 2 with the fins in the deployed mode.
Figure 5:
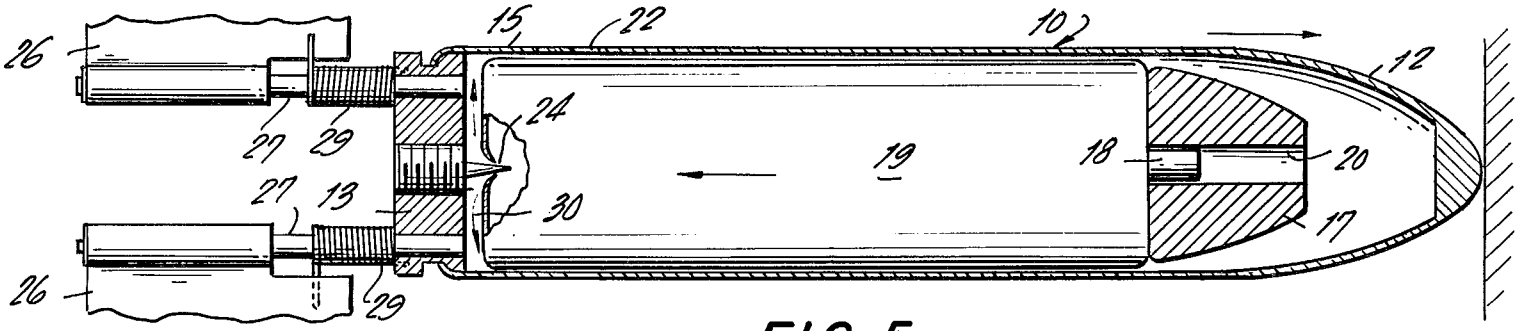
FIG. 5 is a view similar to FIG. 1 showing the projectile's state immediately following launching.

It will be apparent that the embodiment shown in FIG. 4 operates in the same manner as that shown in FIGS. 1 and 5 except that the weak spring 25 initially prevents the piercing pin 24 from entering the container. The spring 25 can be selected with a spring rate which will either permit piercing pin and container contact throughout the flight or separate them during flight. The latter mode may be useful as in dispensing insecticides or seeds over a large area.

Figure 7:
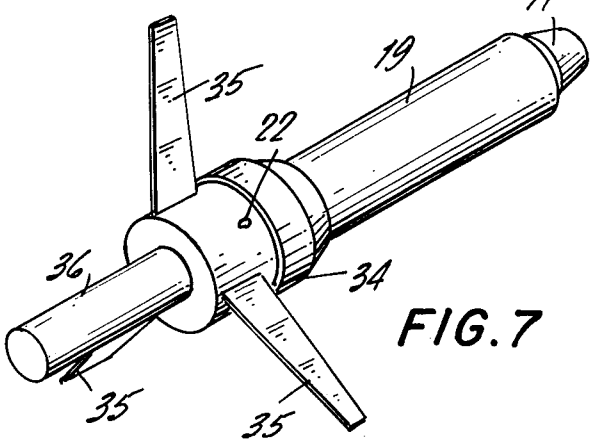
FIG. 7 is a somewhat isometric view of the projectile of FIG. 6 in flight.
Figure 6:
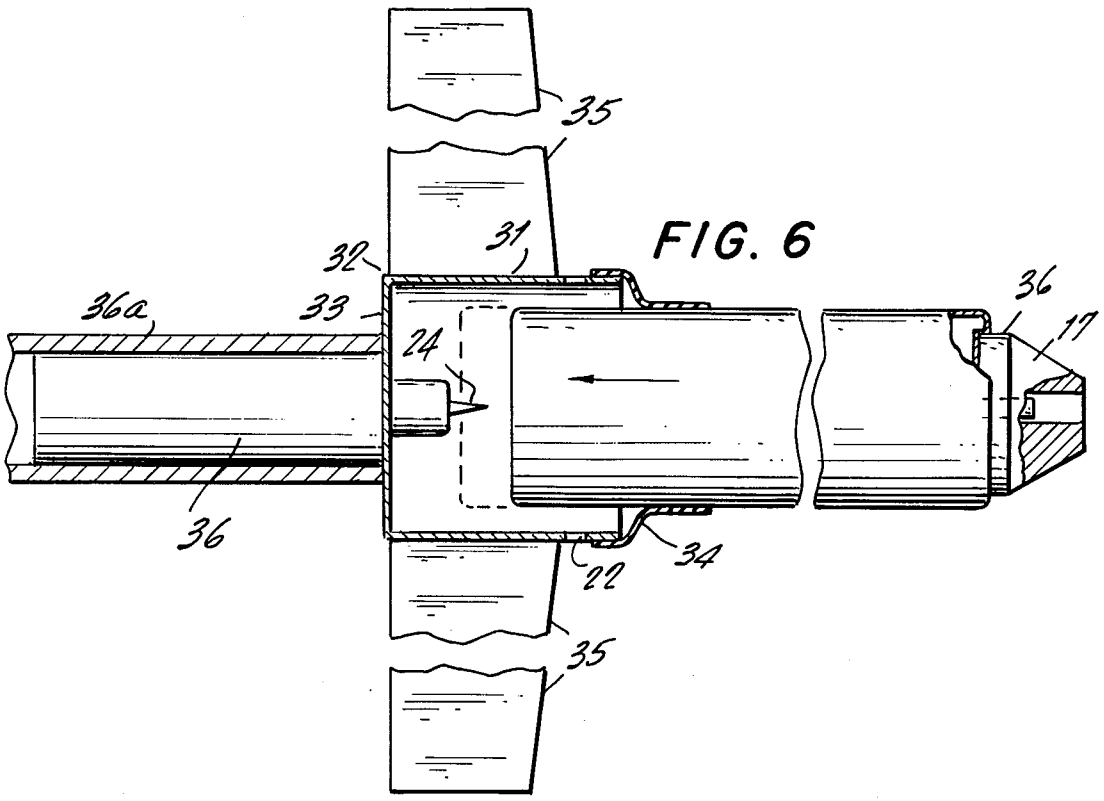
FIG. 6 is a view in longitudinal section showing a further embodiment of the present invention.

Referring to FIGS. 6 and 7 there is shown a further embodiment of the present invention suitable for use with a gun having a blank launching cartridge as a propellant. The housing 31 is in the form of a cylindrical shell 32 closed at its rear by an end wall 33 and reduced in diameter at its front by a necked down portion 34. The piercing pin 24 is secured to the end wall 33 and extends into the housing 31. Exit ports 22 are provided in the wall of the housing and laterally extending fins 35 on the housing guide the projectile in its flight.

In order to fit the projectile to a weapon, a launching tube 36 is secured at one end to the rear of the end wall 33. The opposite end of the launching tube 36 may be closed if it is to fit into the barrel of a weapon 36*a* or open if it is to fit over the barrel of a gun.

The container 19 is slidably and frictionally held within the reduced portion 34 of the housing 31 for a portion of its length so that the bottom of the container is spaced from the piercing pin prior to launch. A recess 36 in the front of the container is provided to receive the stabilizing weight 17 which is press fitted into the recess.

When the projectile shown in FIGS. 6 and 7 is launched the housing moves along the container from the position shown in FIG. 6 in full lines to that shown in dashed lines causing the piercing pin to enter the bottom of the container. The remaining operations of the projectile are the same as those described above in connection with FIGS. 1–5.

Having thus fully described the invention what is claimed and desired to be secured by Letters Patent is:

1. A projectile for delivering and dispersing material under pressure comprising a hollow housing in the form of a cylindrical shell, closed at its rear by an end wall and reduced in diameter at its forward end, a sealed container to receive the material under pressure slidably received for a portion of its length within the reduced diameter portion of the shell, a piercing pin secured to the end wall within the housing rearwardly of the container, and disposed in the path of the container as it slides within the housing, an elongated launching tube secured at one end of the wall and extending rearwardly and axially of the housing, means to prevent the piercing pin from entering the container prior to projectile launching, and exit ports in the housing to permit the material under pressure to escape from the housing after the projectile has been launched and the piercing pin has penetrated the container.

2. A projectile according to claim 1 in which a plurality of fins are secured to and extend outwardly of the housing.

3. A projectile according to claim 1 in which the forward end of the container is recessed to receive a stabilizing weight therein.

4. A projectile according to claim 1 in which the means to prevent the piercing pin from entering the container is the frictional contact between the container and the reduced diameter portion of the housing.

* * * * *